United States Patent [19]

Schnell

[11] Patent Number: 4,494,751

[45] Date of Patent: Jan. 22, 1985

[54] EXERCISE MACHINE

[76] Inventor: Josef Schnell, Sportweg 9, Gachenbach, (Ortsteil Peutenhausen), Fed. Rep. of Germany

[21] Appl. No.: 433,678

[22] Filed: Oct. 12, 1982

[30] Foreign Application Priority Data

Oct. 14, 1981 [DE] Fed. Rep. of Germany ..... 3140859

[51] Int. Cl.[3] ..... A63B 21/06

[52] U.S. Cl. ..... 272/117; 272/134

[58] Field of Search ..... 272/117, 143, 134, 93, 272/130, 136, 142

[56] References Cited

U.S. PATENT DOCUMENTS 3,912,261 10/1975 Lambert ..... 272/134 X 4,296,924 10/1981 Anzaldua et al. ..... 272/117

FOREIGN PATENT DOCUMENTS 2716281 10/1978 Fed. Rep. of Germany ..... 272/117

2213440 1/1980 Fed. Rep. of Germany .

*Primary Examiner*—Richard J. Apley

*Assistant Examiner*—W. Browne

*Attorney, Agent, or Firm*—Karl F. Ross

[57] ABSTRACT

An exercise machine has a frame carrying a seat adapted to support an exercising person in a sitting position, the preferred posture for a person exercising. A pair of upright shafts are journaled in the frame and extend along and rotate about respective axes above the shoulders of the person on the seat. Respective horizontal front arms fixed to the shafts carry respective handles positioned for engagement with the hands and forearms of the person on the seat. Respective right-angle drives on the frame are connected to the shafts for resisting rotation of them in a direction corresponding to displacement of the handles away from the person on the seat with a predetermined force. These drives have rearwardly extending shafts carrying arms on which weights are carried. Respective pivots connect the handles to the respective arms for pivoting of the handles on the arms only in planes including the respective shaft axes. Thus the chest muscles of the person on the seat can be exercised in a natural posture with the effort being exerted horizontally.

8 Claims, 3 Drawing Figures

EXERCISE MACHINE

FIELD OF THE INVENTION

The present invention relates to an exercise machine. More particularly this invention concerns such a machine aimed at developing the chest muscles.

BACKGROUND OF THE INVENTION

In order to develop the chest it is standard practice for the person in training to lie down on his or her back on a weight table. Barbells are then lifted off crutches flanking the table and are raised slowly from a position with the bar lying on the chest of the exerciser to a position elevated above the user's chest with the arms extended.

Such a procedure is disadvantage for two main reasons. First of all it is impossible to tailor the force to the extension. Exercises are preferred which demand less force when the joints involved are less flexed and more force when the limbs are straighter and less liable to dangerous torsions. In addition it is possible for the person exercising to drop the barbell on him or herself, an accident that can be particularly serious when it is considered that a good weight lifter can bench press much more than his or her own weight.

OBJECTS OF THE INVENTION

It is therefore an object of the present invention to provide an improved exercise machine.

Another object is the provision of such an exercise machine which overcomes the above-given disadvantages.

A further object is to provide a chest-excercising apparatus which allows the resistance force to be adjusted and which is safer to use than the prior-art devices.

SUMMARY OF THE INVENTION

These objects are attained according to the instant invention in an exercise machine having a frame carrying a seat adapted to support an exercising person in a sitting position, this being the preferred posture for a person exercising. A pair of upright shafts are journaled in the frame and extend along and rotate about respective axes above the shoulders of the person on the seat. Respective horizontal front arms fixed to the shafts carry respective handles positioned for engagement with the hands and forearms of the person on the seat. Respective drive means on the frame are connected to the shafts for resisting rotation of them in a direction corresponding to displacement of the handles away from the person on the seat with a predetermined force. Thus the chest muscles of the person on the seat can be exercised in a natural posture with the effort being exerted horizontally. In fact when the upright shafts are situated above the shoulder joints near perfect single-joint exercise is achieved. The machine allows the user to exercise in a natural sitting position without the danger of having a large weight suspended above his or her chest. In addition the force is constant, another preferred style of exercise, for most effective working out.

In order that the machine can adapt to different sizes of users it has respective pivots connecting the handles to the respective arms for pivoting of the handles on the arms only in planes including the respective shaft axes. With such an arrangement only the seat need be adjustable, something relatively easy to do, especially because the seat need only support the weight of the user. For most comfortable operation the handles are padded and are provided with handgrips above the padding.

The drive means according to this invention include respective right-angle drives each having in addition to the upright shaft a horizontal shaft projecting away from the person on the seat, a rear arm fixed on the horizontal shaft and pivotal in an upright plane, and a weight on the rear arm remote from the horizontal shaft. In this manner standard disk-type barbell weights can be used and can be relatively easily added or removed from the rear arms to change the loading. Obviously this holds these weights completely out of harm's way, and in particular out of possible contact with the person exercising. It is also of course possible to use slide weights connected via cables deflected over pulleys to these rear arms.

According to another feature of the invention the drives are speed-reducing drives with about a 2:1 reduction from the upright to the horizontal shafts. This allows the loading to be controlled exactly. For instance if the rear arms are set to be vertical when the handles are at the starting position level with the chest, the exercise motion will be very easy to start with, increasing sinusoidally to a maximum with the rear arms horizontal, which 90° pivoting requires a full 180° pivoting of the front arms.

In accordance with another feature of the invention respective abutments are provided on the rear arms between the respective horizontal shafts and weights and respective crutches have lower ends pivoted on the frame and upper ends engageable under the abutments to hold the respective rear arms and weights up. In fact the machine has respective two-arm levers having upper arms constituting the crutches and lower arms extending to the area of the feet of the person on the seat. These two-arm levers can be so constructed as to be stable in positions supporting the respective rear arms and weights and in positions unengageable therewith. Their lower arms have horizontal forward extensions engageable by the legs of the person in the seat for pivoting of the levers between positions supporting the respective rear arms and weights and positions unengageable therewith. Thus if the levers are stable in the supporting and nonsupporting positions the user merely pushes them into the nonsupporting position with his or her legs at the start of the exercise and pushes them back when done. It is also possible to weight or spring-load them into the supporting position, so that when the user releases the extensions with his or her legs the levers automatically pivot into the supporting position.

DESCRIPTION OF THE DRAWING

The above and other features and advantages will become more readily apparent from the following, reference being made to the accompanying drawing in which.

SPECIFIC DESCRIPTION

Figure 1:
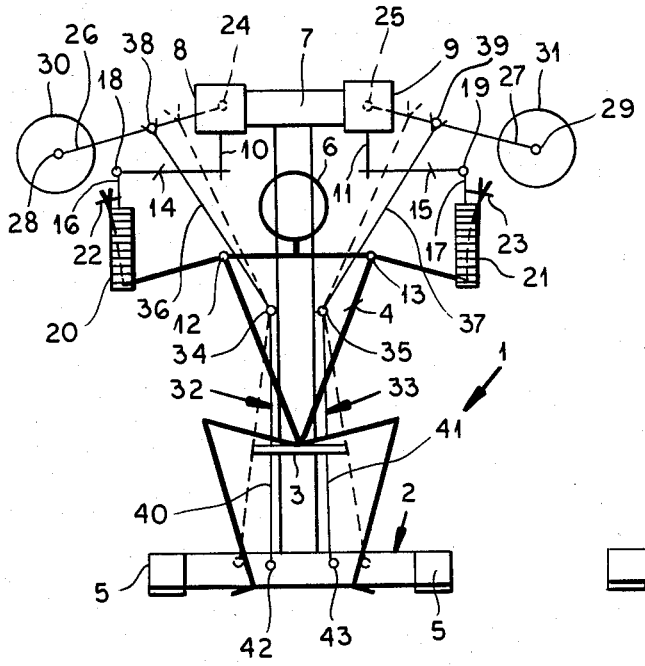
FIG. 1 is a mainly schematic front view of the apparatus according to this invention.

As seen in the drawing an exercise machine 1 has a base 2 carrying a seat 3 for a user 4 and having a pair of elongated feet 5 so it sits solidly on the floor. A transverse beam 7 above the head 6 of the user carries at its ends above the shoulders 12 and 13 of the user 4 right- and left-hand right-angle drives 8 and 9.

Vertical output shafts 10 and 11 of these drives 8 and 9 carry respective horizontal crank arms 14 and 15 pivotal in horizontal planes about the vertical axes of the shafts 10 and 11. Pivots 18 and 19 at the outer ends of the arms 14 and 15 allow depending handles 16 and 17 to swing on these outer ends about respective vertical planes including the respective arms 14 and 15.

The handles 16 and 17 are provided with padding 20 and 21 and with hand grips 22 and 23 so that the user 4 can press agains the handles 16 and 17 with forearms and hands. The ability of the handles 16 and 17 to swing in vertical planes including the axes of the respective shafts 10 and 11 and the respective horizontal front arms 14 and 15 allows the machine to be used by small and large persons without adjustment.

Figure 2:
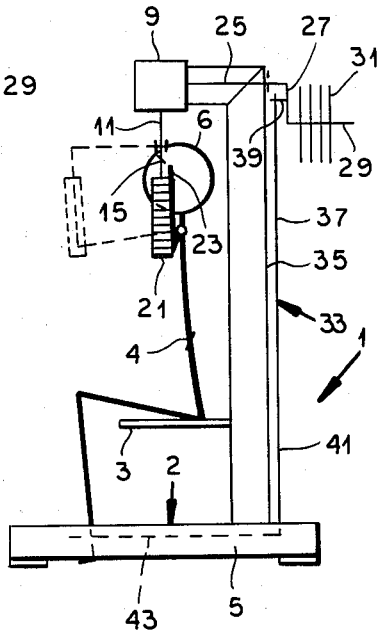
FIGS. 2 and 3 are side and top views of the apparatus, respectively.
Figure 3:
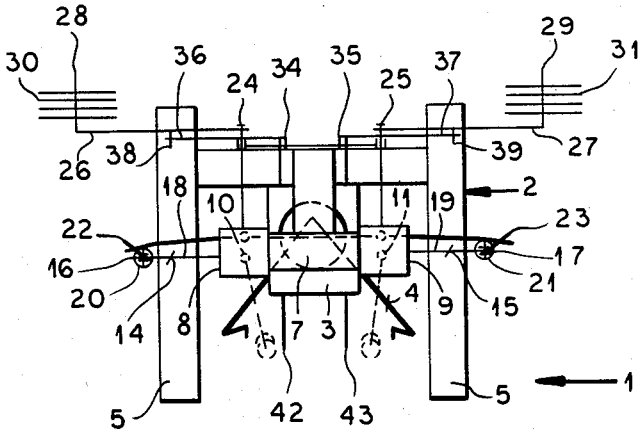

The right-angle drives 8 and 9 have horizontal rearwardly extending input shafts 24 and 25 from which extend arms 26 and 27 having bent-back rear ends 28 and 29 that fit through standard disk-type weights 30 and 31 that therefore are not supported above the user 4, and that in fact can simply be slipped over the ends 28 and 29 without any particular precautions taken to secure them in place. Pushing the handles 16 and 17 forward, to the left in FIG. 2 and down in FIG. 3, pivots the weights 30 and 31 up. The drives 8 and 9 have a 2:1 mechanical advantage from the output shafts 10 and 11 to the input shafts 24 and 25 so that the arms 14 and 15 pivot through twice the angle of the arms 26 and 27.

The machine 1 has right- and left-hand two-arm levers 32 and 33 pivoted on the frame 2 about chest-high horizontal pivots 34 and 35. The levers 32 and 33 have upper arms 36 and 37 formed as crutches to support abutments 38 and 39 located in the middles of the crank arms 26 and 27. The lower arms 40 and 41 stand on the support when the crutches 36 and 37 support the weights 30 and 31. These lower arms 40 and 41 are provided at their lower ends with forwardly projecting extensions 42 and 43 that can be operated by the feet of the user 4 to pivot these levers 32 and 33 between the solid-line supporting position to the dashed-line nonsupporting position. The levers 32 and 33 are weighted such that when they disengage the abutments 38 and 39 their upper ends pivot inward, clear of the abutments 38 and 39 so that thereafter the user can work out with the weights moving into positions lower than their starting positions. At the end of exercise the user 4 simply lets the handles 16 and 17 pivot back and the weights 30 and 31 pivot down. They may also be so constructed as to be stable in both positions, in which case the user 4 can push them out of the way at the start of the exercise, and then push them back with his or her ankles at the end.

It is possible to change the length of the lever arms 26 and 27 as well as to change the size of the weights 30 and 31. In addition the relative angular positions of the arms 26 and 27 on one side and 14 and 15 on the other can be changed. For instance the starting position can have the arms 26 and 27 virtually vertical so that the handles 16 and 17 can be pushed forward easily at first with the force needed to displace them increasing sinusoidally. Of course the length of the upper arms 36 and 37 has to be readjusted in this case.

I claim:

1. An exercise machine comprising:

a frame;

a seat on the frame adapted to support an exercising person in a sitting position;

a pair of upright shafts journaled in the frame and extending along and rotatable about respective upright axes above the shoulders of the person on the seat;

respective horizontal front arms fixed to the shafts;

respective handles carried on the front arms and positioned for engagement with the hands and forearms of the person on the seat;

respective horizontal shafts journaled in the frame and projecting away from the person on the seat;

respective drive means including respective right-angle drives connecting the upright shafts to the respective horizontal shafts for rotation of each of the horizontal shafts synchronously with the respective upright shafts and front arms;

respective rear arms fixed on the horizontal shafts and pivotal in an upright plane, each of the rear arms being generally vertical and extending down from the respective horizontal shaft when the respective front arms are aligned and extend on the respective upright shafts away from each other; and respective means including weights on the rear arms offset from the respective horizontal shafts for resisting rotation of the shafts in a direction corresponding to displacement of the handles away from the person on the seat with a force that increases as the handles move away from the person on the seat, whereby the chest muscles of the person on the seat can be exercised.

2. The chest-muscle exercise machine defined in claim 1 wherein the horizontal arms lie in and define upright planes including the respective shaft axes, the machine further comprising respective pivots connecting the handles to the respective arms for pivoting of the handles on the arms only in the respective upright planes.

3. The chest-muscle exercise machine defined in claim 1 wherein the handles are padded and are provided with handgrips above the padding.

4. The chest-muscle exercise machine defined in claim 1 wherein the drives are speed-reducing drives with about a 2:1 reduction from the upright to the horizontal shafts.

5. An exercise machine comprising:

a frame;

a seat on the frame adapted to support an exercising person in a sitting position;

a pair of upright shafts journaled in the frame and extending along and rotatable about respective axes above the shoulders of the person on the seat;

respective horizontal front arms fized to the shafts;

respective handles carried on the front arms and positioned for engagement with the hands and forearms of the person on the seat;

respective drive means on the frame connected to the shafts for resisting rotation of the shafts in a direction corresponding to displacement of the handles away from the person on the seat with a predetermined force, whereby the chest muscles of the person on the seat can be exercised, the drive means having respective right-angle drives connected to the upright shafts, respective horizontal shafts connected via the respective drives to the upright shafts and projecting away from the person on the seat, respective rear arms fixed on the horizontal shafts and pivotal in an upright plane, and respective weights on the rear arms remote from the horizontal shaft, respective abutments on the rear arms between the respective horizontal shafts and weights; and respective crutches having lower ends pivoted on the frame and upper ends engageable under the abutments to hold the respective rear arms and weights up.

6. The chest-muscle exercise machine defined in claim 5 further comprising respective two-arm levers having upper arms constituting the crutches and lower arms extending to the area of the feet of the person on the seat.

7. The chest-muscle exercise machine defined in claim 6 wherein the two-arm levers are so constructed as to be stable in positions supporting the respective rear arms and weights and in positions unengageable therewith.

8. The chest-muscle exercise machine defined in claim 6 wherein the lower arms of the levers have horizontal forward extensions engageable by the legs of the person in the seat for pivoting of the levers between positions supporting the respective rear arms and weights and positions unengageable therewith.

* * * * *